US009133698B2

(12) United States Patent
Myers et al.

(10) Patent No.: US 9,133,698 B2
(45) Date of Patent: Sep. 15, 2015

(54) MODULAR FRACTURE PLUG AND METHOD OF CONSTRUCTION THEREOF

(75) Inventors: Michael J. Myers, Van Wert, OH (US); Gerald A. Greca, Carleton, MI (US); Michael L. Hastings, Canton, MI (US); Tom Swasey, Okemos, MI (US); Ute Rueger, Ann Arbor, MI (US); Richard C. Floyd, Canton, MI (US)

(73) Assignee: Federal-Mogul Corporation, Southfield, MI (US)

( * ) Notice: Subject to any disclaimer, the term of this patent is extended or adjusted under 35 U.S.C. 154(b) by 727 days.

(21) Appl. No.: 13/273,514

(22) Filed: Oct. 14, 2011

(65) Prior Publication Data

US 2012/0152524 A1 Jun. 21, 2012

Related U.S. Application Data

(60) Provisional application No. 61/425,419, filed on Dec. 21, 2010.

(51) Int. Cl.
*E21B 33/12* (2006.01)
*E21B 43/26* (2006.01)
*E21B 33/134* (2006.01)

(52) U.S. Cl.
CPC ..... *E21B 43/26* (2013.01); *E21B 33/1208* (2013.01); *E21B 33/134* (2013.01)

(58) Field of Classification Search
CPC . E21B 33/12; E21B 33/1204; E21B 33/1208; E21B 33/10; E21B 33/13; E21B 33/134; E21B 33/16; E21B 43/26; E21B 43/261
USPC ..... 166/179, 181, 182, 387, 195, 281, 166/177.5, 308.1
See application file for complete search history.

(56) References Cited

U.S. PATENT DOCUMENTS

| | | | | |
|---|---|---|---|---|
| 3,393,741 | A | 7/1968 | Huitt et al. | |
| 4,509,222 | A | 4/1985 | Knapp | |
| 4,979,562 | A * | 12/1990 | Langer | 166/242.8 |
| 5,095,980 | A * | 3/1992 | Watson | 166/192 |
| 5,433,270 | A * | 7/1995 | LaFleur | 166/152 |

(Continued)

FOREIGN PATENT DOCUMENTS

| | | |
|---|---|---|
| DE | 3843969 C1 | 4/1990 |
| DE | 19641491 | 4/1998 |

(Continued)

OTHER PUBLICATIONS

International Search report PCT/US2011/063197 mailed on Mar. 5, 2013.

*Primary Examiner* — Brad Harcourt
*Assistant Examiner* — David Carroll
(74) *Attorney, Agent, or Firm* — Robert L. Stearns; Dickinson Wright, PLLC

(57) ABSTRACT

A modular fracture plug and method of construction thereof for temporarily sealing off a well is provided. The fracture plug includes an inner substrate material and an outer shell. The outer shell is provided having a plurality of individual sections bonded to one another. One of the sections provides a closed base, while another of the sections provides a closed cover, and one or more of the sections provide an intermediate section between the base and the cover. The intermediate section has a through opening forming at least a portion of the cavity.

9 Claims, 3 Drawing Sheets

(56) References Cited

U.S. PATENT DOCUMENTS

| | | | | |
|---|---|---|---|---|
| 5,509,477 | A * | 4/1996 | Ryan | 166/76.1 |
| 5,762,139 | A * | 6/1998 | Sullaway et al. | 166/291 |
| 6,237,686 | B1 * | 5/2001 | Ryll et al. | 166/153 |
| 6,561,270 | B1 * | 5/2003 | Budde | 166/153 |
| 6,561,279 | B2 | 5/2003 | MacKenzie et al. | |
| 2009/0242191 | A1 | 10/2009 | Wildman et al. | |
| 2013/0213658 | A1 * | 8/2013 | Makowiecki et al. | 166/311 |

FOREIGN PATENT DOCUMENTS

| | | |
|---|---|---|
| DE | 102004012905 | 10/2005 |
| EP | 1298364 | 4/2003 |
| EP | 1521019 | 4/2005 |

* cited by examiner

MODULAR FRACTURE PLUG AND METHOD OF CONSTRUCTION THEREOF

CROSS-REFERENCE TO RELATED APPLICATIONS

This application claims the benefit of U.S. Provisional Application Ser. No. 61/425,419, filed Dec. 21, 2010, which is incorporated herein by reference in its entirety.

BACKGROUND OF THE INVENTION

1. Technical Field

This invention relates generally to oil and natural gas well drilling apparatus and methods of construction thereof, and more particularly to fracture plugs and to their method of construction.

2. Related Art

It is known to use fracture plugs while forming a natural gas well to temporarily close off and isolate adjacent segments of the well from one another. Upon drilling vertically extending and horizontally extending regions of the well, a furthest distal region of the horizontal region of the well is perforated via an explosion process. Then, the shale is fractured via introduction of high pressure water. The fracturing process, sometimes referred to as frac or fracing, causes the shale to fracture, thereby allowing the gas therein to be released into the well. Upon fracing the further region of the well, a fracture plug, sometimes referred more simply as frac plug, is disposed into the well to an area immediately upstream of the fraced region. As such, the fraced region is closed off from the upstream portion of the well by the frac plug, thereby preventing the natural gas from escaping past the frac plug. Then, the process of fracing is performed again in the region immediately upstream of the originally fraced region, with another frac plug then being disposed in the well to close off and isolate the second fraced region from the upstream portion of the well. Accordingly, the two fraced regions are isolated from one another and from the upstream portion of the well with the natural gas being closed off from escaping the well by the separate frac plugs. This process is continued until the entire or substantially entire horizontally extending portion of the well is fraced. Upon completing the fracing and frac plugging process, the frac plugs are then drilled out to open the full length of the horizontal section of the well to allow the natural gas to flow from the well.

The fracture plugs, as noted above, are drilled out to allow the natural gas to be harvested. Accordingly, it is desirable to provide the frac plugs with a central core that is readily penetrable by a drill for removal of the frac plug. As shown in FIG. 1, known frac plugs 1 are constructing having a single-piece structure, with a central sand core 2 fully encapsulated by a monolithic piece of overmolded, rubber that forms an outermost shell layer 3 free of joints or seams. Upon molding the outermost shell layer 3, the rubber material thereof is vulcanized. The frac plug 1 shown also has an innermost rubber layer 4 and an intermediate rubber layer 5 between the outer and inner layers 3, 4. Though these frac plugs are useful for their intended application, their manufacturing process is complex, and thus costly. This results, at least in part, due to having to properly position and maintain the central sand core 2 in a mold cavity prior to molding the outermost shell layer 3.

SUMMARY OF THE INVENTION

In accordance with one aspect of the invention, a modular fracture plug for temporarily sealing off a well is provided.

The fracture plug includes an inner substrate material and an outer shell. The outer shell includes a plurality of individual sections bonded to one another. One of the sections provides a closed base, another of the sections provides a closed cover, and one or more of the sections provide intermediate sections between the base and the cover, wherein the intermediate sections each having through openings forming a portion of the cavity.

According to another aspect of the invention, a method of constructing a modular fracture plug is provided. The method includes forming an outer shell having a plurality of radially outwardly extending annular ribs and a cavity; disposing a substrate material in the cavity, and fixing a cover over the opening to fully encapsulate the substrate material in the closed and sealed cavity.

In accordance with another aspect of the invention, the method further includes forming the outer shell by bonding a plurality of separately molded annular members to one another prior to disposing the substrate material in the cavity.

In accordance with another aspect of the invention, the method further includes keying a plurality of the annular members to one another with mating joints bonded to one another.

In accordance with another aspect of the invention, the method further includes providing the substrate material from a recycled material.

In accordance with another aspect of the invention, the method further includes forming the outer shell having a base having the same configuration as the cover.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
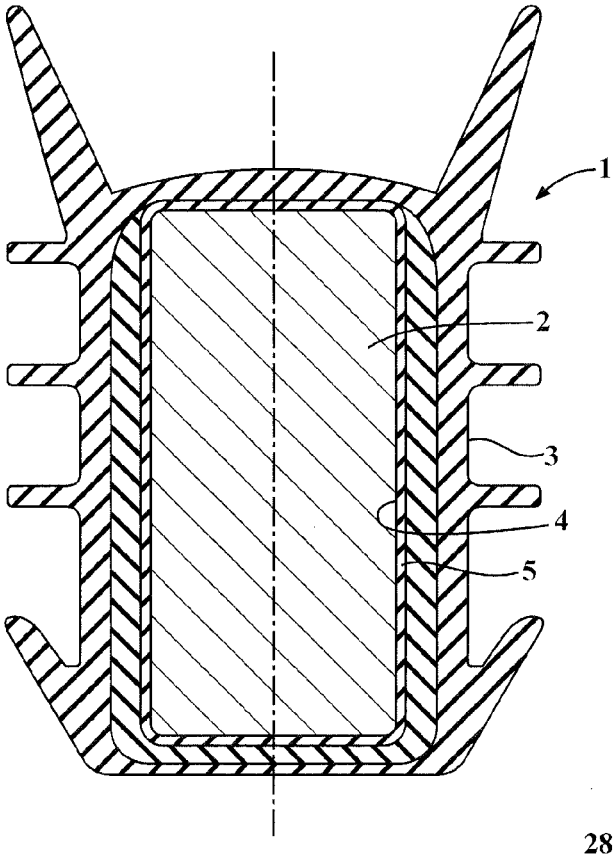
FIG. 1 Prior Art
FIG. 1 is a cross-sectional view of a fracture plug constructed in accordance with the prior art.
Figure 2:
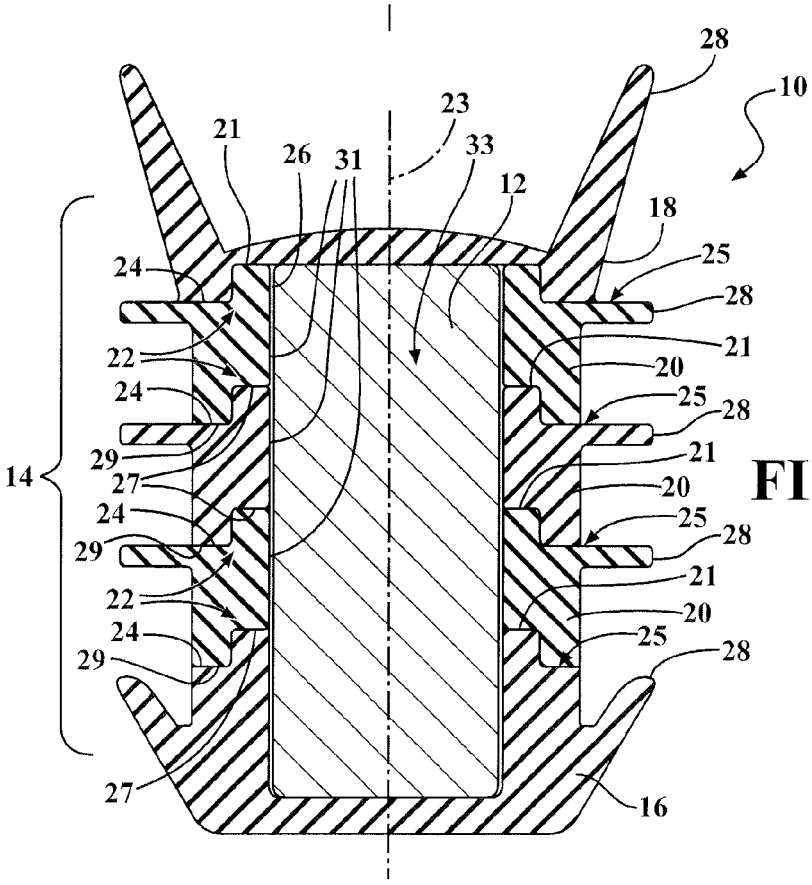
FIG. 2 is a cross-sectional view of a fracture plug constructed in accordance with one aspect of the invention.

Referring in more detail to the drawings, FIG. 2 illustrates a modular oil/gas fracture plug, referred to hereafter simply as plug 10, constructed in accordance with one aspect of the invention. The plug 10 is used to temporarily isolate pockets, also referred to as chambers, of a well from one another, thereby allowing a plurality of individual sections of the well to be fractured and temporarily isolated from one another, as is known in the art of well drilling. Upon completing the fracture process of the well, the plugs 10 are configured to be drilled-out to allow the oil/gas to be extracted from the entire well. The plug 10 is constructed in modular form in accordance with the invention to greatly simplify the manufacturing process associated with the construction of the plug 10. As such, the total cost associated with the manufacture of the plug 10 is greatly reduced over known processes used to construct the plugs 1 associated with the prior art.

The plug 10 generally includes an inner substrate material 12 and a polymeric outer shell, such as a rubber outer shell 14, for example. It should be recognized that polymeric materials other than rubber, although a preferred material, could be used to form the outer shell 14. The outer shell 14 is provided having a plurality of individual, separately manufactured sections fixed to one another, such as by being bonded to one another. The outer shell 14 is shown as having a pair of solid end covers, with one end cover being referred to as a base section, referred to hereafter as base 16, another of the end covers being referred to as a cover section, referred to hereafter as cover 18, and one or more (i.e. plurality) intermediate sections 20 between the base 16 and cover 18. When a plurality of intermediate sections 20 are used, in order to simply manufacture and reduce the cost associated with manufacture, it is preferred that the individual intermediate sections 20 be formed having the same geometric configuration. Each of the separate sections are fixed to one another about their respective outer periphery to fully encapsulate the inner substrate material 12. To facilitate locating the sections 16, 18, 20 relative to one another and bonding the separate sections to one another, the sections 16, 18, 20 are preferably keyed to one another in via keying features 22, e.g. tongue and groove or other suitable alignment mechanisms, such that the keying features 22 conform and mate with one another in puzzle-like fashion to ensure the separate sections mate in a particular, coaxially aligned configuration along a central axis 23 while being bonded to one another at mating joints 24. The keying features 22 illustrated include projections 21 extending axially in generally parallel relation to the central axis 23 from one end face 25 and recessed grooves 27 extending axially into an opposite end face 29, wherein the grooves 27 are configured for close mating receipt of the projections 21. Accordingly, the keying features 22 assure the sections 16, 18, 20 are properly aligned, radially and axially, during the bonding process, and further act to provide enhanced rigidity to the outer shell 14 upon being completed.

During assembly, a plurality of the sections, such as the base 16, being solid in form, and thus being impervious, and one or more intermediate sections 20, being annular, and thus having central through openings 31, are firstly stacked in keyed relation with one another and bonded together to form their respective bond joints 24. The bonding can be performed using any suitable adhesive, depending on the material used to mold the separate outer shell components, e.g. styrene-butadiene chemistry (plastic with elastomer), and further, the sections could be welded together. Upon completing the initial assembly of the outer shell 14, a partially enclosed cavity 33 is formed via the stacked through openings 29 with an opening 26 remaining in the partially assembled outer shell into which the inner substrate material 12 is introduced. In the illustrated embodiment of FIG. 2, the opening 26 into the cavity 33 is provided by the through opening 29 in the uppermost intermediate section 20 furthest from the bonded and sealed base 16. Then, upon disposing the substrate material 12 into the cavity 33 of the partially assembled outer shell 14, the remaining section, shown as the cover 18, is keyed and bonded to the uppermost intermediate section 20 to fully close off the opening 26, thereby causing the substrate material 12 to be fully encapsulated within the sealed cavity.

Each of the sections 16, 18, 20 are shown as having radially outwardly extending annular fins, also referred to as lips 28, though it should be recognized that one or more of the sections could be formed without lips, if desired. The lips 28 are sized to provide an interference fit between the plug 10 and the cylindrical wall of the drilled well passage (not shown). The important aspect of the lips 28 is that they provide the gas-tight sealing desired until the time the plugs 10 are drilled out. To facilitate insertion of the plug 10, the lips 28 on the base 16 and the cover 18 are inclined to face rearwardly away from the direction of insertion.

The substrate material 12 that is disposed into the cavity 33 provided by the partially assembled outer shell 14 can be provided of various materials. Further, given the substrate material 12 is essentially filled into the existing cavity 33 and then fully encapsulated by the cover 18, the manufacturing process is greatly simplified over that of the prior art discussed in the Background above. The substrate material 12 can be provided as a mixture of sand that includes Silicon and Oxygen and Carbon baked binder, for example, and/or other materials, e.g. recycled material, such as scrap rubber, for example, foam or other scrap materials and green materials could be used to form at least a portion of the substrate material 12 or the entire substrate material 12. As such, the density, whether homogeneous or heterogeneous, can be precisely controlled, as desired. This is made feasible given the substrate material 12 is disposed into a existing cavity of the partially assembled outer shell 14, much like filling any vessel with a material.

Then, upon disposing the substrate material 12 into the cavity 33, the remaining section, e.g. cover 18, is bonded to close the opening 26 to complete assembly of the outer shell 14. Thus, the substrate material 12 is bounded and fully encapsulated in the now sealed off cavity 31 upon finishing construction of the plug 10.

Figure 3:
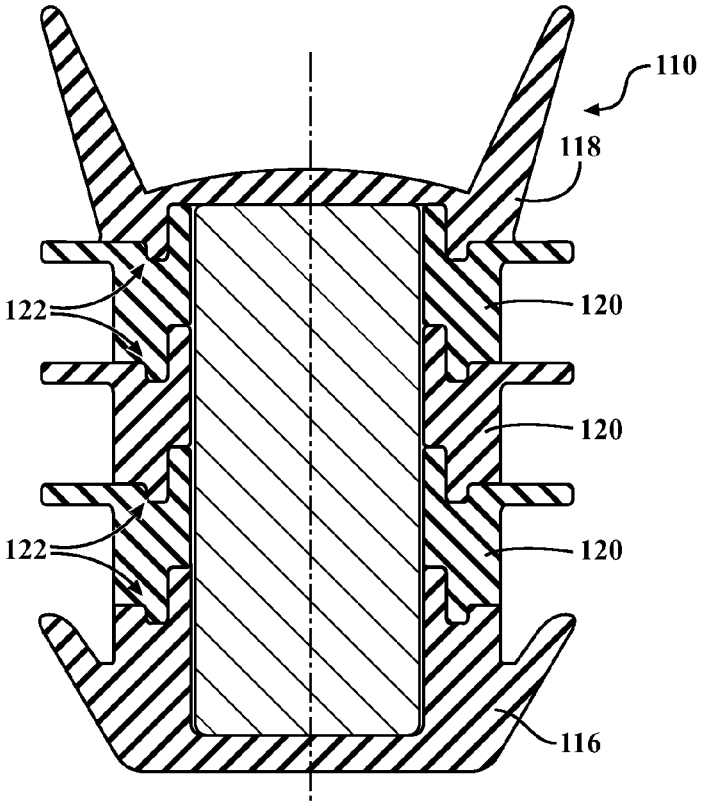
FIG. 3 is a cross-sectional view of a fracture plug constructed in accordance with another aspect of the invention.
Figure 4:
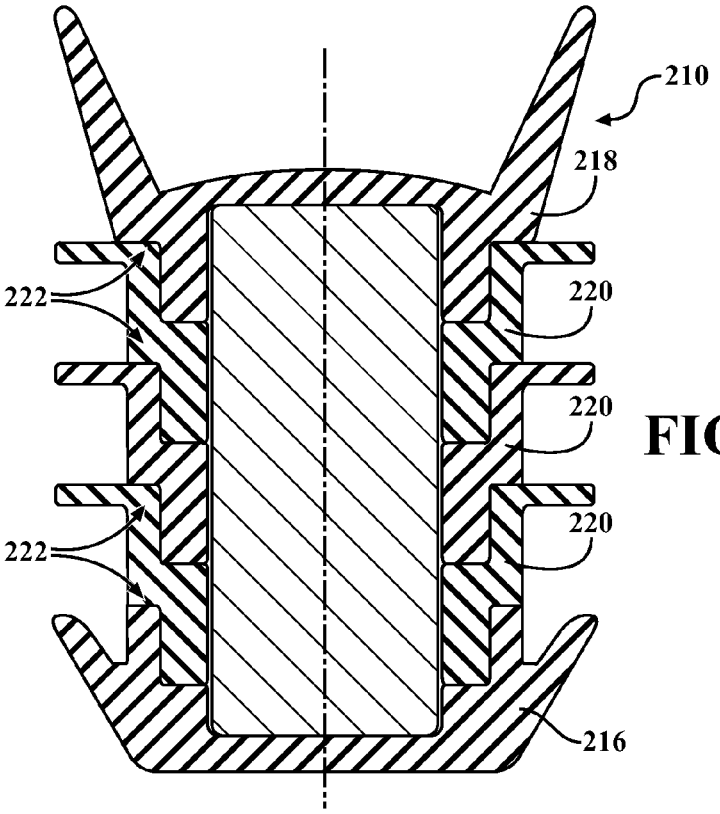
FIG. 4 is a cross-sectional view of a fracture plug constructed in accordance with another aspect of the invention.
Figure 5:
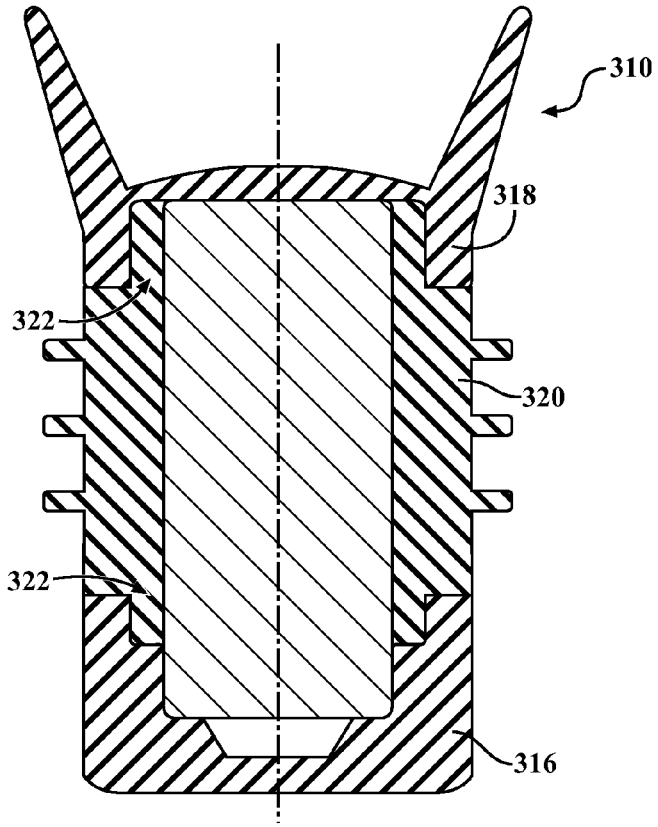
FIG. 5 is a cross-sectional view of a fracture plug constructed in accordance with another aspect of the invention.

In FIGS. 3, 4, 5 and 6, plugs 110, 210, 310, 410 constructed in accordance with further embodiments are illustrated, wherein the same reference numerals, offset by a factor of 100, 200, 300, 400, respectively, are used to identify like features discussed above. Accordingly, the plugs 110, 210, 310, 410 each include a base 116, 216, 316, 416; a cover 118, 218, 318, 418; and one or more intermediate sections 120, 220, 320, 420. A notable difference between the embodiments illustrated in FIGS. 3-5 is with regard to the configuration of keying features 122, 222, 322 used to interconnect the sections 116, 118, 120; 216, 218, 220; 316, 318, 320 to one another. Otherwise, the plugs 110, 210, 310 are constructed generally the same as described with respect to the plug 10.

Figure 6:
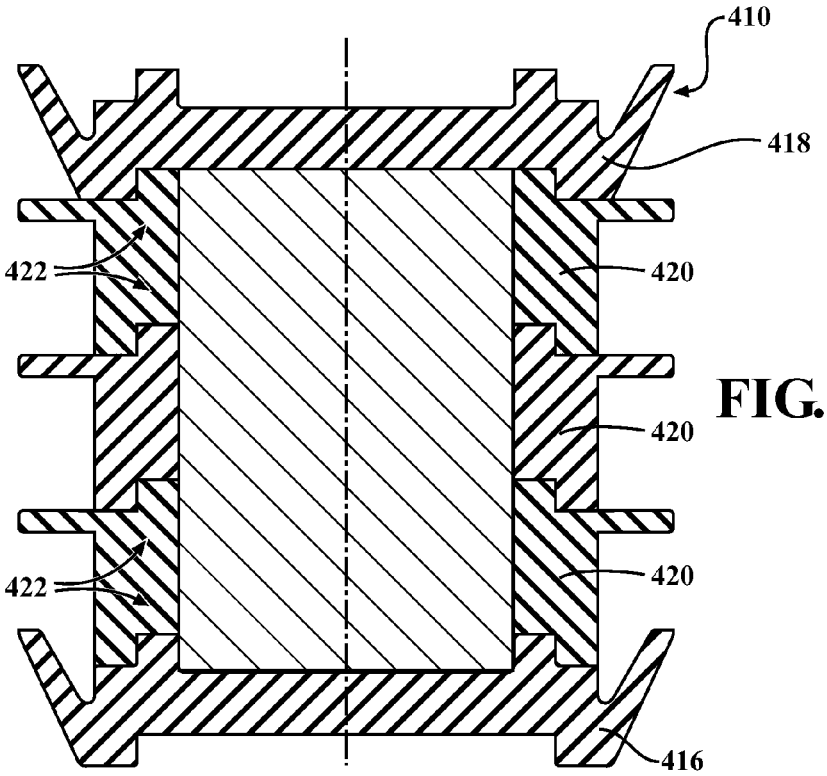
FIG. 6 is a cross-sectional view of a fracture plug constructed in accordance with yet another aspect of the invention.

As shown in FIG. 6, a further difference that distinguishes the plug 410 from the other plugs 10, 210, 310 discussed above is with regard to a base 416 and cover 418 of the plug 410. The base 416 and the cover 418 are the same in geometric configuration with one another, and thus, have the same shape which allows them to be interchanged with one another in assembly, as is the case with the intermediate sections 420. Accordingly, rather than having to have different molds and processes in the manufacture of the base 416 and cover 418, they are made as a single interchangeable component from a single mold. Thus, in construction of the plug 410, only two different configurations of the individual sections are required, one for the intermediate sections 420 and one for both the base and cover 416, 418. Thus, not only is assembly made easier, but so too is the manufacture of the base 416 and cover 418, thereby reducing the cost associate with manufacture of the base 416 and cover 418, and thus, the plug 410 in general.

Many modifications and variations of the present invention are possible in light of the above teachings. It is, therefore, to be understood that the invention may be practiced otherwise than as specifically described, and that the scope of the invention is defined by any ultimately allowed claims.

What is claimed is:

1. A modular fracture plug, comprising:

a polymeric outer shell having an encapsulated inner cavity;

an inner substrate material disposed in said inner cavity, said substrate material being a mixture including sand and recycled rubber; and wherein said outer shell is provided having a plurality of individual, separately manufactured sections having outer peripheries bonded to one another with an adhesive, one of said sections providing a closed base, another of said sections providing a closed cover, and one or more of said sections providing intermediate sections between said base and said cover, said intermediate sections each having through openings forming a part of said cavity.

2. The modular fracture plug of claim 1 wherein said base and said cover have the same shape.

3. A modular fracture plug, comprising:

a polymeric outer shell having an encapsulated inner cavity;

an inner substrate material disposed in said inner cavity;

wherein said outer shell is provided having a plurality of individual, separately manufactured sections having outer peripheries bonded to one another with an adhesive, one of said sections providing a closed base, another of said sections providing a closed cover, and one or more of said sections providing intermediate sections between said base and said cover, said intermediate sections each having through openings forming a part of said cavity; and wherein said substrate material includes recycled material including recycled rubber.

4. The modular fracture plug of claim 1 wherein at least some of said intermediate sections include radially outwardly projecting fins constructed as a monolithic piece of material therewith.

5. A method of constructing a modular fracture plug, comprising:

forming an outer shell by bonding a plurality of individual sections, including an impervious base and a plurality of intermediate sections, to one another about their outer peripheries with an adhesive and providing the outer shell having a plurality of radially outwardly extending lips and a cavity extending along a central axis of the outer shell through the plurality of intermediate sections to the impervious base;

disposing a substrate material in the cavity;

fixing a cover over the cavity to fully seal the cavity and fully encapsulate the substrate material within the cavity between the cover and the base; and further including providing the substrate material as a mixture including sand and recycled rubber.

6. The method of claim 5 further including forming the radially outwardly extending lips as a monolithic piece of material with the intermediate sections.

7. The method of claim 5 further including providing the cover and the base having the same geometric configuration.

8. The method of claim 5 further including providing the sand including Silicon, Oxygen and a Carbon baked binder.

9. A method of constructing a modular fracture plug, comprising:

forming an outer shell by bonding a plurality of individual sections, including an impervious base and a plurality of intermediate sections, to one another about their outer peripheries with an adhesive and providing the outer shell having a plurality of radially outwardly extending lips and a cavity extending along a central axis of the outer shell through the plurality of intermediate sections to the impervious base;

disposing a substrate material in the cavity;

fixing a cover over the cavity to fully seal the cavity and fully encapsulate the substrate material within the cavity between the cover and the base; and providing at least a portion of the substrate material as recycled material, wherein at least some of the recycled material is rubber.

* * * * *